US005659903A

United States Patent [19]

Hammarstedt

[11] Patent Number: 5,659,903

[45] Date of Patent: Aug. 26, 1997

[54] FLUSHING DEVICE FOR WATER-CLOSETS

[75] Inventor: Curt Lennart Hammarstedt, Alstermo, Sweden

[73] Assignee: Ifo Sanitar AB, Bromolla, Sweden

[21] Appl. No.: 563,828

[22] Filed: Nov. 28, 1995

[30] Foreign Application Priority Data

Nov. 29, 1994 [SE] Sweden ..... 9404138

[51] Int. Cl.[6] ..... E03D 1/14

[52] U.S. Cl. ..... 4/325; 4/324

[58] Field of Search ..... 4/325, 324, 394, 4/391, 410

[56] References Cited

U.S. PATENT DOCUMENTS

| | | | |
|---|---|---|---|
| 4,025,968 | 5/1977 | Davis | 4/325 |
| 4,483,024 | 11/1984 | Troeh | 4/324 |
| 4,833,738 | 5/1989 | Scott | 4/325 |
| 4,969,218 | 11/1990 | Comparetti | 4/325 |
| 5,003,644 | 4/1991 | Huang | 4/324 |
| 5,235,707 | 8/1993 | Wang-on | 4/324 |
| 5,396,665 | 3/1995 | Raz et al. | 4/325 |

FOREIGN PATENT DOCUMENTS

| | | |
|---|---|---|
| 2 676 480 | 11/1992 | France . |
| 25 16 058 A1 | 10/1976 | Germany . |
| 32 21 747 A1 | 12/1983 | Germany . |
| 399 576 | 2/1978 | Sweden . |
| 2 077 790 | 12/1981 | United Kingdom . |

*Primary Examiner*—David J. Walczak

*Attorney, Agent, or Firm*—Luedeka, Neely & Graham, P.C.

[57] ABSTRACT

A flushing device which permits flushing with two different amounts of flushing fluid. The bottom valve member of the device comprises two float rods which are each connected to a float. The float rod for the small flushing amount is fixedly connected to the bottom valve member, whereas the float rod for the large flushing amount is connected to the bottom valve member via a lost-motion coupling to make it possible for the bottom valve member to move upwards and downwards relative to this float road. In the resting position, the float rod for flushing with the large amount of flushing fluid is locked by means of a lock, such that the float connected to this float rod does not affect the lowering of the bottom valve member towards its valve seat during flushing. The flushing with the small amount of flushing fluid will thus be determined completely by the movements of the other float rod and its associated float. When releasing the mechanism for flushing with the large amount of flushing fluid, a release member is actuated, which first releases the above-mentioned lock and then raises the bottom valve member from its seat by means of the float rod intended for the large flushing amount.

10 Claims, 5 Drawing Sheets

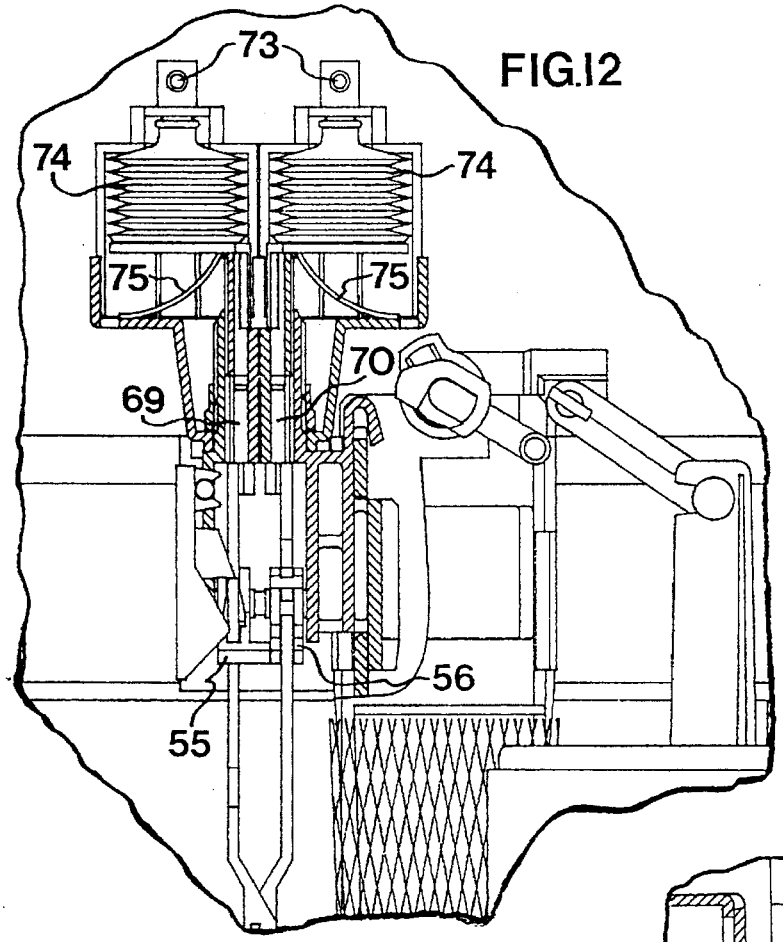
FIG.12
FIG.13
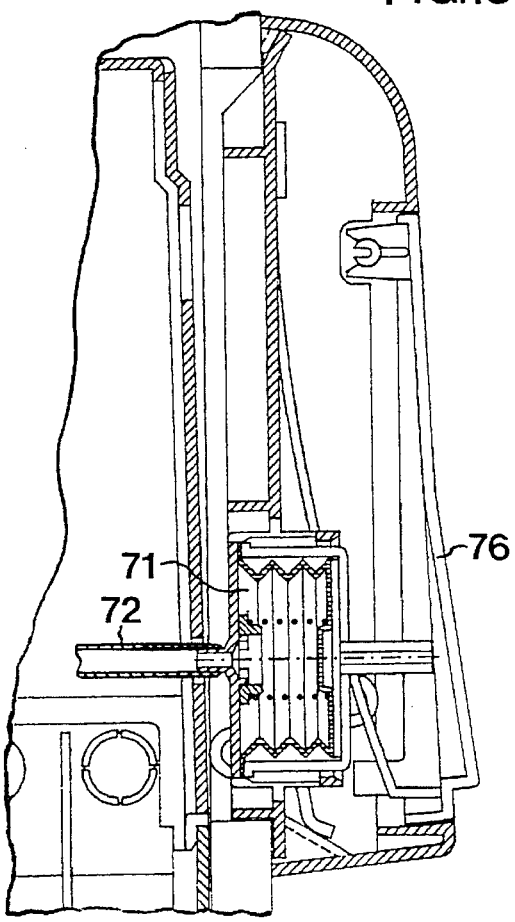
FIG.11
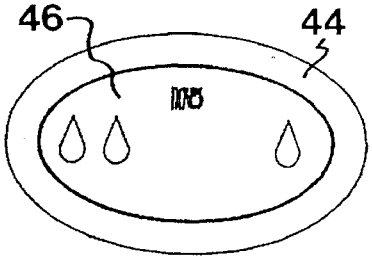

FLUSHING DEVICE FOR WATER-CLOSETS

BACKGROUND OF THE INVENTION

The present invention relates to a flushing device for water-closets, and more specifically a device which makes it possible for the user to optionally flush with a small or a large amount of flushing fluid.

DESCRIPTION OF THE PRIOR ART

GB-A-2,077,790 discloses a flushing device which permits flushing with two different amounts of flushing fluid. The device comprises two floats, arranged one above the other and acting on the same float or lifting rod. The upper float is displaceable in the vertical direction of the float rod but is, in the starting position, fixed relative thereto by means of a detent pawl. When flushing with the large amount of flushing fluid, the upper float is hooked onto the float rod by means of the detent pawl so as to be prevented from following the downward movement of the flushing fluid surface. As a result, the lower float only will control the flushing process and keep the bottom valve raised from its seat until all the flushing fluid has been discharged. When flushing with the small amount of flushing fluid, the upper float is released so as to be able to move vertically relative to the float rod. At the same time, the float rod, the lower float fixedly connected therewith and, thus, also the bottom valve member will be raised, which then leaves its seat. When the fluid level has descended to a certain level, the upper float will, under the action of gravity, come into engagement with an abutment fitted on the float rod, such that the upper float will, by its mass, affect the float rod and the lower float. This makes the upward force of the float assembly decrease and thus the bottom valve close, before the flushing fluid tank has been completely emptied. This prior-art mechanism thus is based on a change of the upward force of the float assembly for affecting the amount of flushing fluid by bringing forward the closing of the bottom valve. This type of flushing device therefore requires accurate trimming-in of the various parts of the mechanism relative to each other in respect of mass and moving distance of the upper float relative to the float rod. This also makes it difficult to change the relationship between the large and the small amount of flushing fluid, after the flushing device has been constructed and mounted.

U.S. Pat. No. 5,003,644 also discloses a flushing device which permits flushing with different amounts of flushing fluid. This device comprises two different flushing valves which are arranged on different levels along an outlet pipe extending upwards from the bottom of the flushing fluid tank. This known device is thus complicated and cannot be adjusted in respect of the individual amounts of flushing fluid.

Also U.S. Pat. No. 4,483,024 discloses a flushing device which permits flushing with two different amounts of flushing fluid. This mechanism is based on the idea of adjusting the amount of flushing fluid by applying light or heavy pressure to a release mechanism. The device comprises a lifting rod which is connected to a float and a bottom valve member, which is fixed to one end of a link arm. The link arm comprises a locking pin which is adapted to cooperate with a detent pawl which is formed on one end of a two-armed lever. At the other end of this lever there is a float. The pivot axis of the two-armed lever is arranged at a fixed level relative to the bottom of the tank. When raising the lifting rod by applying a light pressure, the locking pin will be stopped against the detent pawl without moving this aside. The tank is discharged fully in dependence of the float connected with the lifting rod. When applying a heavier pressure to the lifting rod and, thus, the link arm connected with the bottom valve, the locking pin of the link arm will move aside the detent pawl against the action of the upward force of the float connected with the two-armed lever. This prevents the closing of the bottom valve until the fluid level in the tank has fallen sufficiently to cause the float to sink and thus the detent pawl to be raised so as to release the locking pin and hence the valve flap of the bottom valve for closing thereof. This prior-art mechanism requires a bottom valve, whose valve member is pivotable relative to its valve seat. This type of valve is often very difficult to make completely tight unless the link to which the pivotable valve member or valve flap is fixed is accurately guided. Accurate guidance or control often requires greater accuracy in manufacture and consequently an increase of the manufacturing costs and the price of the device. Wear of bushings may then cause lack of tightness and necessitate repeated maintenance.

U.S. Pat. No. 5,235,707 also discloses a flushing device which permits flushing with two different amounts of flushing fluid. In the '707 patent case a valve flap is used to close the bottom valve. Here, the valve flap is actuated by a separate float body when the small amount of flushing fluid is to be flushed. This float body thus has a projection which mechanically engages the valve flap and presses this downwards against its seat, when the small amount of flushing fluid has left the tank. This known mechanism suffers from essentially the same drawbacks as the mechanism according to U.S. Pat. No. 4,483,024.

SE-B-399,576 discloses a flushing device which permits flushing with two different amounts of flushing fluid by two separate outlet valves arranged concentrically relative to each other being used and controlled by their respective floats and release mechanisms. This prior-art device is complicated and difficult to adjust for changing the amounts of flushing fluid.

FR-A-2,676,480 also discloses a flushing device which permits flushing with two different amounts of flushing fluid. Like the flushing device according to GB-A-2,077,790, this known flushing device comprises two floats which are arranged on different levels along a common float rod and one of which is held in place when flushing with the small amount of flushing fluid is to be carried out. In the construction according to GB-A-2,077,790, one float is displaceable, whereas in the construction according to FR-A-2,676,480 both floats are displaceable along the float rod. The device according to FR-A-2,676,480 comprises two levers to facilitate flushing with the small or the large amount of flushing fluid. The device comprises a tubular float rod, identical upper and lower floats and a detent pawl for holding down the lower float when flushing with the small amount of flushing fluid and for releasing this float when flushing with the large amount of flushing fluid. In the power transmission train between the lever which is used to release the flushing with the large amount of flushing fluid and the float rod, there is a lost-motion coupling. The upper float is displaceable along the common float rod between an upper and a lower abutment arranged thereon. The lower float is displaceable along the float rod between the upper abutment and a bottom flange of the mechanism. When flushing with the small amount of flushing fluid, the float rod and thus the bottom valve member are supported by the upper float only, which in this case acts against the upper abutment, the lower float on the other hand being kept in its bottom position so as not to be able to affect the downward movement of the float rod during flushing. The size of the small amount of flushing fluid is determined by the position of the upper abutment along the float rod. When flushing with the large amount of flushing fluid, the detent pawl is actuated, such that the lower float is released and will act against the lower abutment of the float rod. After the level in the flushing fluid tank has fallen in correspondence with the small amount of flushing fluid, the upper float will no longer act buoyantly against the upper abutment, whereby the lower float will determine the downward movement of the float rod and thus the bottom valve member until the maximum amount of flushing fluid has been discharged. This known mechanism certainly permits flushing with two different amounts of flushing fluid and therefore permits a reduction of the consumption of flushing fluid. However, the mechanism still suffers from drawbacks by being difficult to adjust for regulating the large and the small amount of flushing fluid. Such regulation can be achieved merely by making changes in the mechanism and by moving the two abutments along the common float rod. Moreover, the mechanism is such as to require great accuracy when trimming in the components of the release mechanism which determine the operation of the detent pawl for holding down the lower float so as to permit flushing with the small amount of flushing fluid.

Even if the prior-art flushing devices permit saving of flushing fluid by facilitating flushing with a small or a large amount of flushing fluid according to the user's wish, the known devices thus suffer from various drawbacks. These reside in, inter alia, difficulties in regulating the small and the large amount of flushing fluid and the relationship between the amounts of flushing fluid and in the devices being designed in a complicated manner and, consequently, complicated to install and trim in.

SUMMARY OF THE INVENTION

An object of the present invention therefore is to obviate one or more of these drawbacks and provide a new flushing device, which also permits flushing with two different amounts of flushing fluid, but which is designed in a simpler manner and can be easily adjusted to regulate the size of at least the small amount of flushing fluid and, thus, the relationship between the small and the large amount of flushing fluid.

A further object of the invention is to provide a flushing device which has these properties and which is a simple construction and easy to manufacture. One more object is to provide a flushing device which is designed so as to be easy to operate also for children and people having reduced ability to use their hands.

One or more of these objects of the invention are achieved by a flushing device which is designed as defined in claim 1. The subclaims define especially preferred embodiments of the invention.

To sum up, the invention thus resides in a flushing device which permits flushing with two different amounts of flushing fluid and which, to this end, comprises a bottom valve, whose valve member has two lifting or float rods which are each connected to a float. The float rod for the small amount of flushing fluid is fixedly connected to the bottom valve member, whereas the float rod for the large amount of flushing fluid is connected to the bottom valve member via a lost-motion coupling to make it possible for the bottom valve member to move upwards and downwards relative to this float rod. In the resting position, the float rod for flushing with the large amount of flushing fluid is locked by means of a lock, such that the float connected to this float rod cannot affect the lowering of the bottom valve member against its valve seat during flushing. The flushing with the small amount of flushing fluid will thus be determined completely by the movements of the other float rod and the associated float. When releasing the mechanism for flushing with the large amount of flushing fluid, a release member is actuated, which first releases the above-mentioned lock and then raises the bottom valve member from its seat by means of the float rod and the float intended for the large flushing amount.

BRIEF DESCRIPTION OF THE DRAWING

The invention will now be described in more detail with reference to the accompanying drawings, which illustrate a preferred embodiment of a flushing device according to the invention.

FIG. 11 is a top plan view of the design of that part of the release button of the release mechanism which is visible from the outside of the tank.

FIG. 12 shows an alternative release mechanism for operating the flushing device in FIG. 1.

FIG. 13 shows a release button relating to this alternative mechanism.

DESCRIPTION OF THE PREFERRED EMBODIMENT

Figure 2:
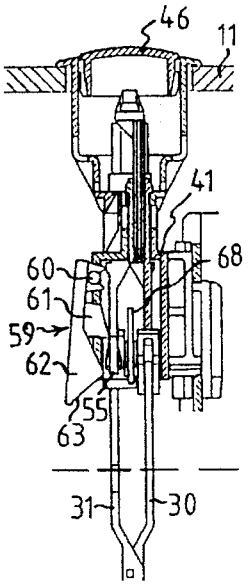
FIG. 2 is a view and section similar to FIG. 1, a detent pawl included in the device being moved aside to permit flushing with a large amount of flushing fluid.

The embodiment of a flushing device according to the present invention as shown in FIGS. 1–11 is mounted in a tank having a bottom 10 and a cover 11. The device is mounted in two holes in the bottom of the tank. An inlet pipe 12 for flushing fluid extends through one hole. For sealing, use is made of a pipe socket 13, a seal 14 and a nut 15. The device comprises a bottom valve 16 whose lower part 17 is in the form of a pipe socket which extends through the tank bottom 10 and is sealed against this by means of a nut 18 and a seal 19. The upper end of the lower part is formed with an annular seat 20. This is adapted to cooperate with a bottom valve member 21 which has an annular valve surface 22 designed complimentarily to the seat 20. The valve member 21 is guided for movements essentially axially towards and away from the seat 20. For this guiding, use is made of four guide means 23 extending upwards from the lower part 17 to form a slightly conical guide surface for the valve member 21. Other means for guiding the valve member relative to the surface of the seat are possible.

The inlet pipe 12 is connected to an inlet valve 24, which is controlled by a float 25 in conventional manner for filling the tank with flushing fluid, when the liquid level falls below a certain filling level. When supplying the fluid, it flows downwards along a column 26, which is fixedly connected to the lower part 17 of the bottom valve and the pipe socket 13. This column supports the mechanism and thus constitutes the frame of the flushing device. The column 26 is in prior-art manner provided with a coating or stocking 27, which serves to reduce the sound from the flushing fluid during filling of the tank.

At the upper end of the column 26, the release mechanism 28 of the device is arranged. From the outside of the flushing fluid tank, only the release button 46 of the mechanism is to be seen, which in the embodiment illustrated is designed as a rocker and is oval (see FIG. 11). However, other shapes are possible as is the use of two separate buttons for releasing and flushing with the small and the large amount of flushing fluid.

Before the release mechanism is described in more detail, it should be mentioned that the inventive flushing device is equipped with two float rods 30, 31 each having a float 32, 33. The floats 32, 33 are adjustable on different levels along the respective float rods 30, 31. The float rods preferably have a setting scale 29 in order to facilitate the adjusting operation.

The float rod 30 and its float 32 are fixedly connected to the bottom valve member 21 by means of a distance sleeve 34 and a coupling 35 with locking pawls 36. The float rod 31 and its float 33 are also fixedly connected to the bottom valve member 21, but the coupling to this is designed as a lost-motion coupling 37. The lost-motion coupling has, in the embodiment shown, been provided by omitting the distance sleeve 34 in the coupling 35, such that the legs of the locking pawls 36 are not prevented from moving downwards relative to the bottom valve member 21, as will be seen when comparing FIGS. 3 and 4. Owing to this construction, the bottom valve member 21 can move a certain distance upwards relative to the float rod 31 and the float 33, when the bottom valve member 21 is pulled upwards by the float rod 30 under the action of the lever arm 55 and the buoyancy of the float 32, if the device is released to flush with the small amount of flushing fluid.

Figure 3:
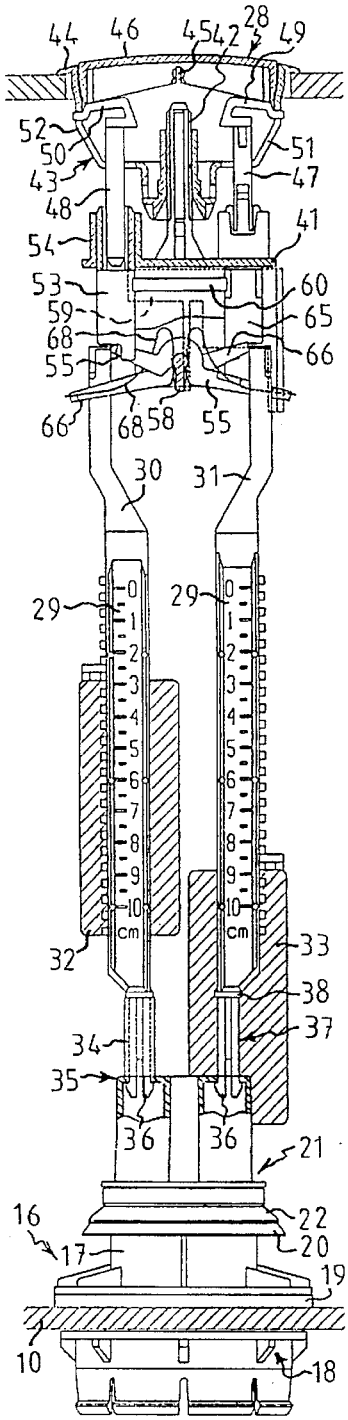
FIG. 3 is a sectional view approximately along line III—III in FIG. 1, illustrating the device in its resting position.
Figure 4:
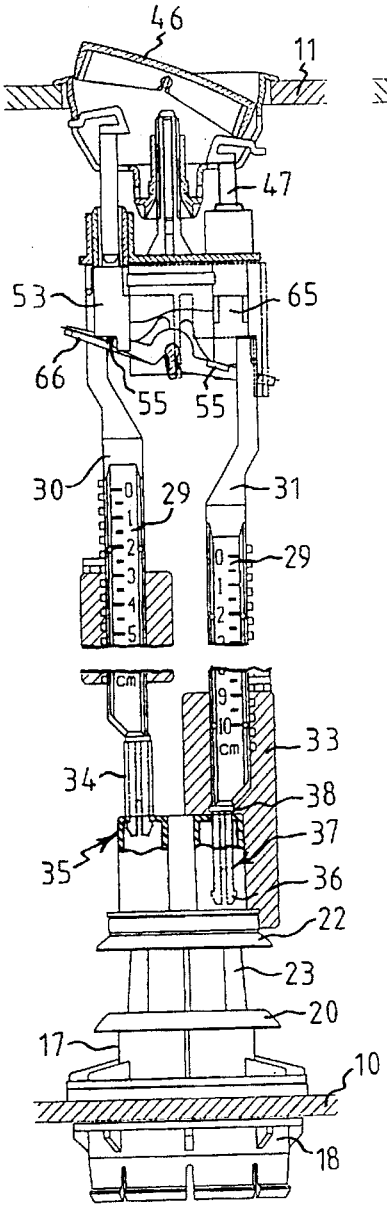
FIG. 4 is a sectional view similar to FIG. 3, illustrating the device in a position for flushing with a small amount of flushing fluid.

FIGS. 3–6 illustrate four different positions of the release mechanism of the device. FIG. 3 shows the resting position, i.e. the starting position of the mechanism. The tank is filled up to the level that is indicated by F in FIG. 1. FIG. 4 shows the mechanism in the position for flushing with a small flushing amount. In this position, the float rod 31 and its float 33 are locked in their positions shown in FIG. 3 and the bottom valve member 21 is raised by the float rod 30 and the float 32. The upward movement of the float rod 30 and the float 32 is restricted by the bottom valve member 21 coming into engagement with an abutment surface 38 of the float rod 31. The downward movement of the bottom valve member 21 is, however, completely controlled by the float 32 and the float rod 30. This results in the amount of flushing fluid in this case being small by the float 32 being positioned higher up relative to the tank bottom as compared with the float 33. The actual amount of flushing fluid is determined by the horizontal cross-sectional area of the tank and the difference between the level when the tank is completely filled and the level on the occasion when the float 32 has sunk so far down that the valve surface 22 of the bottom valve member 21 comes into sealing engagement with the valve seat 20. By the float 32 being adjustable along the float rod 30, this flushing amount—the "small flushing amount"—can be readily adjusted also after the installation of the mechanism. Such a possible level of the fluid surface after flushing with the small flushing amount is indicated by L in FIG. 1.

Figure 1:
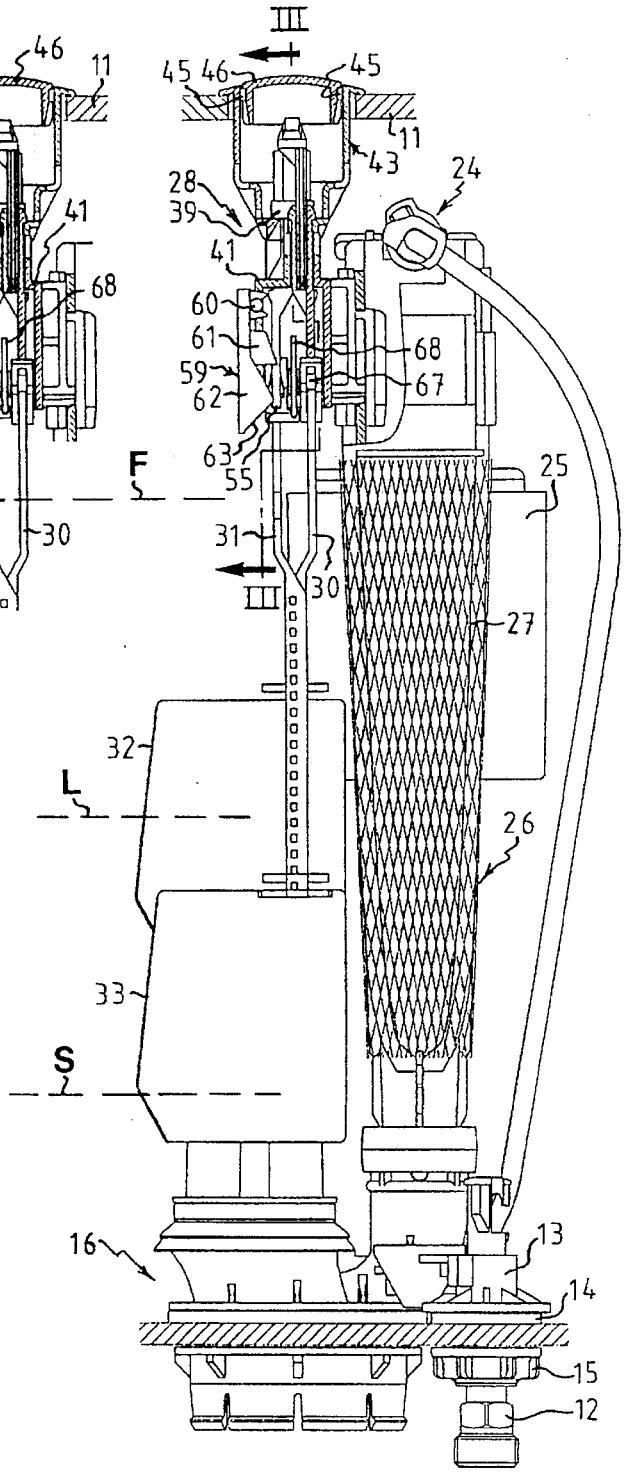
FIG. 1 is a side view, partly in vertical section, of a flushing device according to the invention in its resting position.

When flushing with the large amount of flushing fluid the release mechanism is actuated such that a detent pawl 59 (which will be described in more detail below) included in the mechanism releases the float rod 31 and the float 33 to make the float rod 31 rise and thus carry along both the bottom valve member 21 and the other float rod 30 with its fixed float 32 in the upward movement. The level to which the bottom valve member 21 is raised can be determined by projections (not shown) which are formed on the guide means 23 and which mechanically stop the upward movement. When the flushing fluid flows out and the fluid level falls in the tank, the downward movement of the bottom valve member 21 is initially determined by the two floats 32, 33 and the two float rods 30, 31. At the final stage, after discharging a fluid amount corresponding to the small amount of flushing fluid, the downward movement is determined exclusively by the float 33 and the float rod 31. FIG. 1 shows a flushing fluid level S, which is one of the possible levels of the fluid which remains in the tank after flushing with the large amount of flushing fluid.

To release the flushing with the small or the large amount of flushing fluid, the release mechanism 28 is used. This is formed at the upper end of the column 26. The column comprises a laterally projecting bracket 41 which is rigidly connected to or integrated with the column 26 and which serves as a frame for the release mechanism. At the upper end of the bracket there is an upwardly directed threaded pin 42. A cup-shaped cover nut 43 is attached to the pin by means of an adjusting nut 39. The cover nut has an upwardly directed flange 44 which rests against the upper side of the tank cover 11. The entire flushing device thus is clamped between the tank cover 11 and the tank bottom 10 by the cover nut 43 clamping the cover against the tank and by the requisite abutment being obtained by means of the nuts 15 and 18.

On the inside of the cup-shaped cover nut 43, there are projecting mounting pins 45. The release button 46 is pivotally mounted on these mounting pins, such that it can be tilted in one direction when flushing with the small amount of flushing fluid, and in the other direction when flushing with the large amount. The release button is kept in its normal position by means of two spring pins 47, 48. A free end of the springs 49, 50 of the spring pins is guided in slit-shaped recesses 51, 52 in the cover nut. In the embodiment illustrated, the cover nut is oval, as shown in FIG. 11.

The spring pin 48 is fixedly connected to a pressure arm 53 for the large amount of flushing fluid. This pressure arm is mounted in a bearing sleeve 54 on the bracket 41, such that the pressure arm can move upwards and downwards to a limited extent. The movements of the pressure arm in vertical direction are transferred to one end of a lever arm 55 for the large amount of flushing fluid. This lever arm is formed with a longitudinal slit 56, through which the associated float rod 31 extends. For transferring the lifting force from the lever arm 55 to the float rod 31, there are outwardly projecting lugs 57 on both sides of the float rod 31.

The lever arm 55 is pivotally supported by a bearing beam 58, which in the embodiment shown is integrated with the bracket or frame 41, but which could be designed as a separate component which is mounted in the bracket 41.

Figure 5:
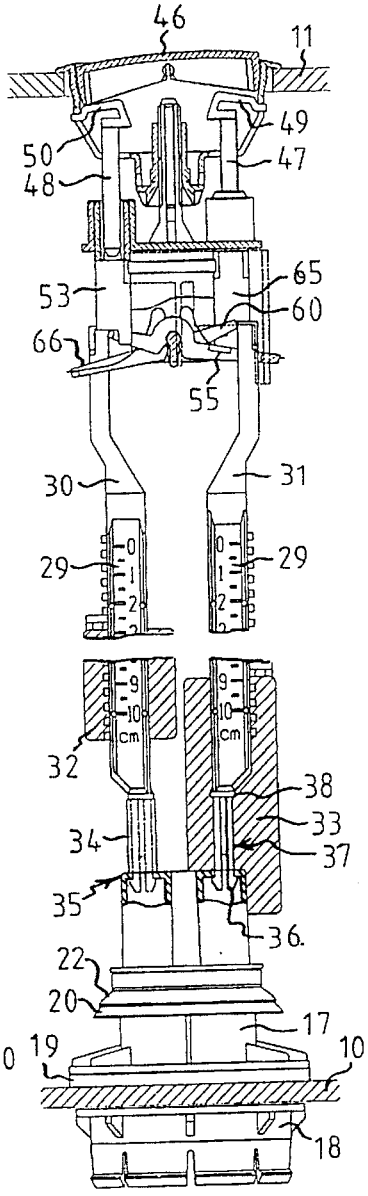
FIG. 5 is a sectional view similar to FIG. 3, illustrating the device in the same position as in FIG. 2, in which the detent pawl of the device has been moved aside.
Figure 6:
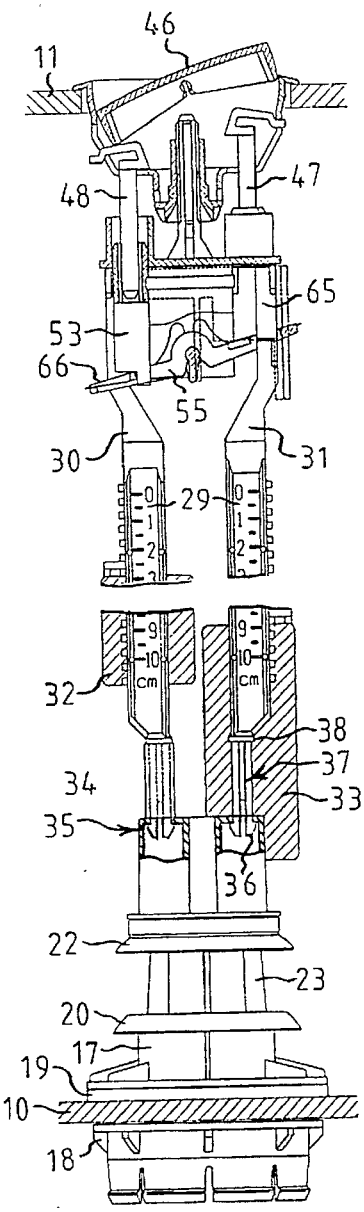
FIG. 6 is a sectional view similar to FIG. 3, illustrating the device in the position for starting a flushing process with a large amount of flushing fluid.
Figure 8:
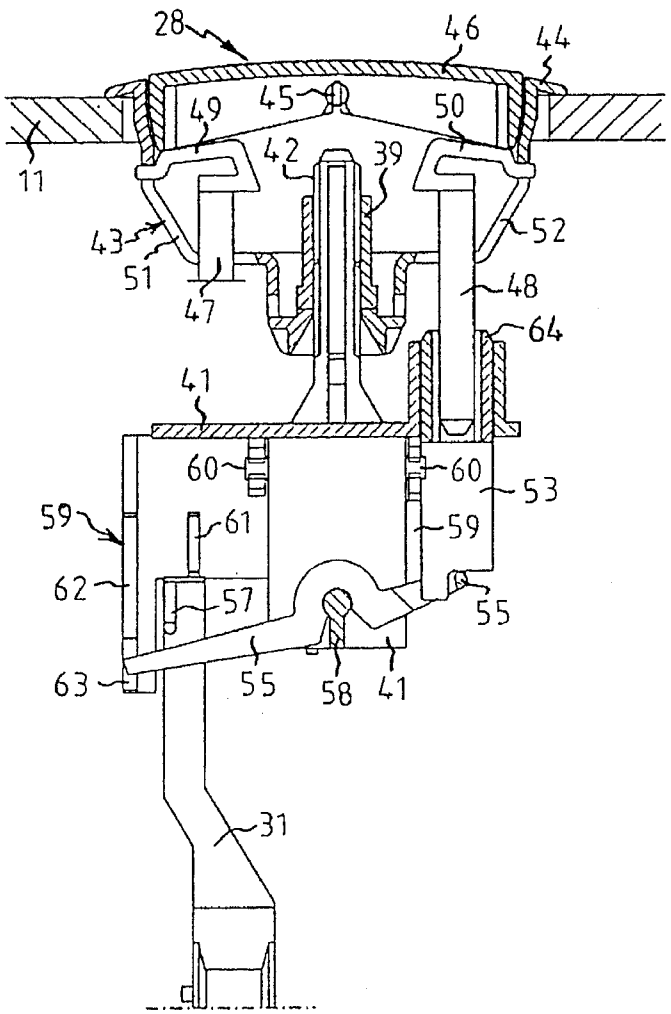
FIG. 8 is a sectional view along line VIII—VIII in FIG. 7.
Figure 7:
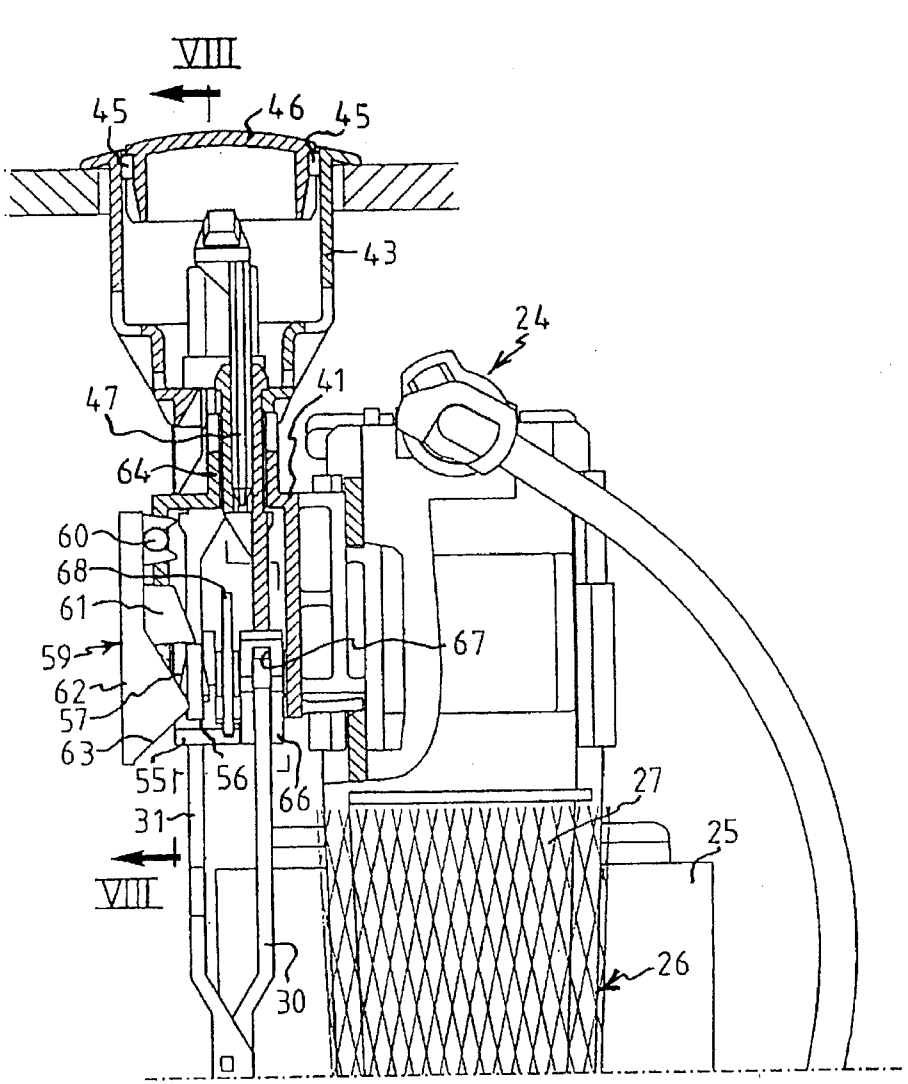
FIG. 7 shows the upper part of the device in FIG. 1 on a larger scale.
Figure 10:
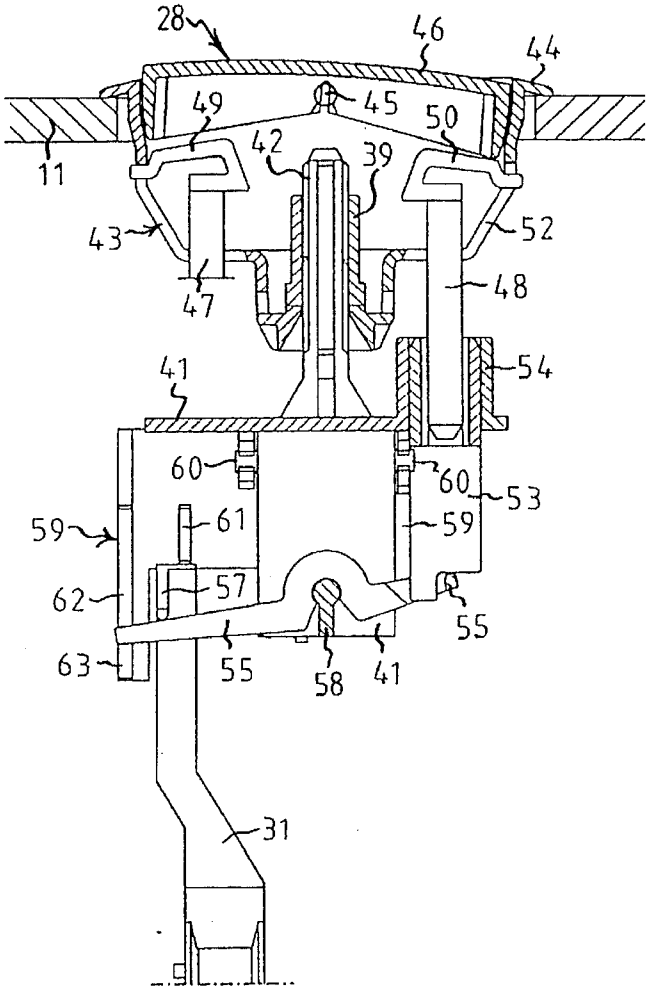
FIG. 10 is a sectional view along line X—X in FIG. 9.
Figure 9:
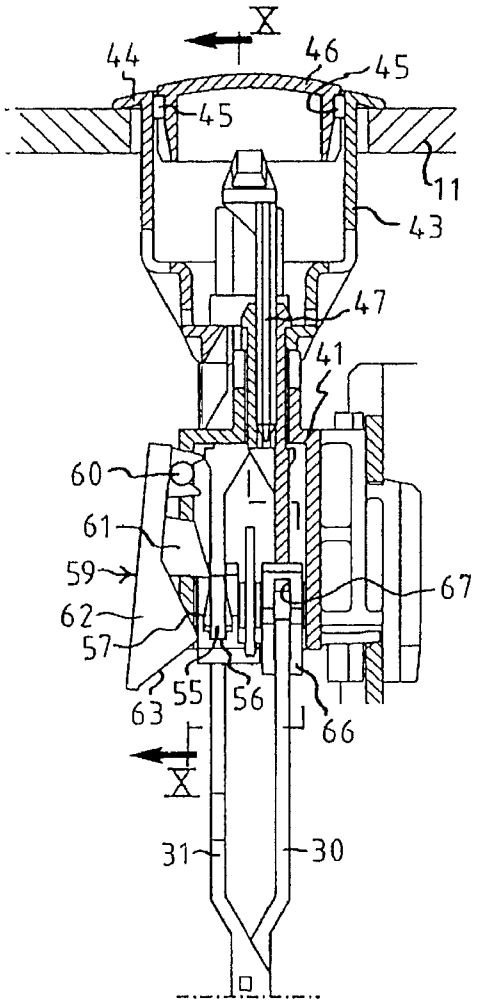
FIG. 9 shows the upper part of the device in FIG. 2 on a larger scale.

That end of the lever arm 55 which is adapted to cooperate with the lugs 57 is also used to actuate a detent pawl 59. This is mounted on a shaft 60 attached to the bracket 41. The detent pawl comprises a detent lug 61, which is adapted to cooperate with the upper end of the float rod 31 for preventing raising of the float rod when flushing with the small amount of flushing fluid is to be carried out. The detent pawl 59 also comprises a cam projection 62 having a cam surface 63. The outer end of the lever arm 55 acts against this cam surface. During the first part of a pressing-down or tilting of the release button 46 for flushing with the large amount of flushing fluid (to the right in respect of FIGS. 8–9, and to the left in respect of FIGS. 2–5), the outer end of the lever arm 55 slides against the cam surface 63, whereby the detent pawl 59 is pivoted clockwise in respect of FIG. 7. By this pivoting motion, the detent lug 61 will release the float rod 31. FIGS. 5 and 8 illustrate the positions of the release button and the mechanism precisely when the detent lug 61 has been moved away from the path of motion of the upper end of the float rod. To permit this partial raising of the lever arm 55, before this begins to raise the float rod 31 and thus the bottom valve member 21, the lifting lugs 57 are arranged on such a level along the float rod 31 that the detent lug 61 has released the float rod 31 before the lever arm 55 engages the lifting lugs. This lost-motion is to be seen when comparing FIGS. 8 and 10.

For flushing with the small amount of flushing fluid, the release button 46 is pressed so as to tilt to the right from the position shown in FIG. 3 to the one shown in FIG. 4. Such tilting causes pressing-down of the spring pin 47. This is displaceably mounted in a bearing sleeve 64 which is integrated with the bracket 41. The spring pin 47 is fixedly connected to a pressure arm 65 for releasing the flushing with the small amount of flushing fluid. The pressure arm acts against a further lever arm 66 which resembles the lever arm 55 and is mounted on the bearing beam 58. The lever arm 66 is formed with a longitudinal slit 67, through which the associated float rod 30 extends. In order to facilitate raising of the float rod, this is formed with outwardly projecting lifting lugs, which correspond to the lifting lugs 57 but are concealed behind the lever arm 66 in the Figures. During pressing-down, the lever arm 66 is thus pivoted clockwise from the position shown in FIG. 3 to the one in FIG. 4 and simultaneously the float rod 30 is raised and the bottom valve opens by the bottom valve member 21 following the upward movement of the float rod.

Since the float rod 31 is locked against upward movement owing to the detent lug 61 of the detent pawl 59 engaging with the upper end of the float rod 31, this float rod and the associated float 33 are prevented from following the upward movement of the bottom valve member 21. This upward movement is made possible by the float rod 31 being connected to the bottom valve member 21 via the lost-motion coupling 37, as described above.

To return the lever arms 55 and 56 and the components actuated by them to their neutral positions or resting positions (shown in FIGS. 3, 7 and 8), a leaf spring 68 is mounted on the bearing beam 58. The leaf spring is designed so as to be held in place on the bearing beam by its own resilience. One free end of the leaf spring abuts against that end of the lever arm 55 which engages with the float rod 31. The other free end of the leaf spring engages that end of the lever arm 66 which engages with the float rod 30.

Owing to the embodiment of the flushing device as described above, the same force will be necessary when releasing the flushing with a small amount of flushing fluid and the flushing with a large amount. Besides, the device is such that the operation is easy to understand and an adjustment of the flushing amounts for the small and large amounts of fluid can readily be carried out in connection with or after the original installation. All functions of the device are collected as a unit which by simple measures can be installed by tightening the nuts 15, 18 and 39.

In the embodiment according to FIGS. 1–11, a mechanical coupling is used to transfer pressure force applied to the release button 46 directly to the lever arms 55, 66 of the release mechanism. If, for aesthetical or other reasons, the release button is to be arranged in a position other than in the tank cover 11, the construction shown in FIGS. 12 and 13 can be used. In this construction, the operating forces are transferred pneumatically or hydraulically from release buttons 76 on the side wall of the tank to the respective spring pins 69, 70. For operation, there is thus a liquid- or gas-filled bellows 71, which is mechanically connected to each release button 76 and which, via a hose 72, is connected to an inlet 73 of a corresponding liquid- or gas-filled bellows 74. This has, in turn, a projection cooperating with the spring pins 69, 70 and is biased in the direction of compression (upwards in FIG. 12) by means of a leaf spring 75 or some other pressure spring. Besides, this mechanism functions in the same manner as the mechanism in the embodiment according to FIGS. 1–11.

What is claimed is:

1. A flushing device for a water-closet containing a flushing fluid which comprises:

a bottom valve member raisable from a resting position on a valve seat by means of a float rod and release mechanism, operable for flushing with a large or small amount of flushing fluid, said float rod and release mechanism including:

first and second float rods connected to the bottom valve member, each float rod having a float, wherein the first float rod serves to flush with the small amount of flushing fluid and being fixedly connected to the bottom valve member and the second float rod serves to flush with the large amount of flushing fluid and being connected to the bottom valve member via a lost-motion coupling so as to be movable upwards and downwards in relation thereto, a lock which is arranged to lock the second float rod in order to prevent raising of the second float rod and its float when flushing with the small amount of flushing fluid, and to prevent the float connected to the second float rod from counteracting the lowering of the bottom valve member towards its resting position while flushing with the small amount of flushing fluid so that the flushing with the small amount of flushing fluid is accomplished by the action of the first float rod and its associated float, and a release member which, when flushing with the large amount of flushing fluid, is adapted to release said lock and raise the bottom valve member from its resting position by means of the second float rod, wherein the release mechanism comprises a lever arm for operating the second float rod which second float rod has at least one lifting lug with which said lever arm is adapted to cooperate, for raising the second float rod, wherein the lock contains a detent pawl which is pivotally arranged on a frame included in the flushing device, which detent pawl comprises a locking lug which is movable into and out of the path of said second float rod, said detent pawl further comprising a cam surface cooperating with said lever arm, wherein the cam surface, the locking lug of the detent pawl, the lever arm and the second float rod are designed so that as the lever arm engages the cam surface, the detent pawl is pivoted outwards and the locking lug is moved out of the path of the second float rod so that the lever arm comes into lifting engagement with said second float rod.

2. The flushing device as claimed in claim 1, wherein the float for determining the small amount of flushing fluid is displaceable along the associated first float rod and fixable on various levels along the first float rod to adjust the small amount of flushing fluid.

3. The flushing device as claimed in claim 2, wherein the float for determining the large amount of flushing fluid is displaceable along the associated second float rod and fixable on various levels along the second float rod to adjust the large amount of flushing fluid.

4. The flushing device as claimed in claim 3, wherein the lost-motion coupling between the second float rod and the bottom valve member comprises a snap locking device having at least two locking pawls which have outwardly directed lugs wherein the snap locking device is slidably engaged with a mounting hole in the bottom valve member.

5. The flushing device as claimed in claim 1, wherein the float for determining the large amount of flushing fluid is displaceable along the associated second float rod and fixable on various levels along the second float rod to adjust the large amount of flushing fluid.

6. The flushing device as claimed in claim 5, wherein the lost-motion coupling between the second float rod and the bottom valve member comprises a snap locking device having at least two locking pawls which have outwardly directed lugs wherein the snap locking device is slidably engaged with a mounting hole in the bottom valve member.

7. A flushing device for a water-closet containing a flushing fluid which comprises:

a bottom valve member raisable from a resting position on a valve seat by means of a float rod and release mechanism, operable for flushing with a large or small amount of flushing fluid, said float rod and release mechanism including:

first and second float rods connected to the bottom valve member, each float rod having a float, wherein the first float rod serves to flush with the small amount of flushing fluid and being fixedly connected to the bottom valve member and the second float rod serves to flush with the large amount of flushing fluid and being connected to the bottom valve member via a lost-motion coupling so as to be movable upwards and downwards in relation thereto, wherein the lost-motion coupling between the second float rod and the bottom valve member comprises a snap locking device having at least two locking pawls which have outwardly directed lugs wherein the snap locking device is slidably engaged with a mounting hole in the bottom valve member, a lock which is arranged to lock the second float rod in order to prevent raising of the second float rod and its float when flushing with the small amount of flushing fluid, and to prevent the float connected to the second float rod from counteracting the lowering of the bottom valve member towards its resting position while flushing with the small amount of flushing fluid so that the flushing with the small amount of flushing fluid is accomplished by the action of the first float rod and its associated float, and a release member which, when flushing with the large flushing fluid, is adapted to release said lock and raise the bottom valve member from its resting position by means of the second float rod.

8. The flushing device as claimed in claim 7, wherein the float for determining the large amount of flushing fluid is displaceable along the associated second float rod and fixable on various levels along the second float rod to adjust the large amount of flushing fluid.

9. The flushing device as claimed in claim 7, wherein the float for determining the small amount of flushing fluid is displaceable along the associated firs float rod and fixable on various levels along the first float rod to adjust the small amount of flushing fluid.

10. The flushing device as claimed in claim 9, wherein the float for determining the large amount of flushing fluid is displaceable along the associated second float rod and fixable on various levels along the second float rod to adjust the large amount of flushing fluid.

* * * * *